United States Patent [19]

St. Pierre

[11] Patent Number: 4,604,076

[45] Date of Patent: Aug. 5, 1986

[54] TOY STOVE WITH SIMULATED TIMER

[75] Inventor: Raymond M. St. Pierre, Hawthorne, Calif.

[73] Assignee: Mattel, Inc., Hawthorne, Calif.

[21] Appl. No.: 736,998

[22] Filed: May 22, 1985

[51] Int. Cl.[4] ..... A63H 3/52; A63H 5/00

[52] U.S. Cl. ..... 446/418; 446/481

[58] Field of Search ..... 446/418, 481

[56] References Cited

U.S. PATENT DOCUMENTS 1,522,988 1/1925 Warren .
2,227,182 12/1940 Finch et al. ..... 194/1
3,765,120 10/1973 Waak ..... 46/14

FOREIGN PATENT DOCUMENTS 1022947 1/1958 Fed. Rep. of Germany ..... 446/481
1200993 12/1959 France ..... 446/481
805421 12/1958 United Kingdom ..... 446/481

*Primary Examiner*—F. Barry Shay
*Attorney, Agent, or Firm*—Ronald M. Goldman; Melvin A. Klein; John G. Mesaros

[57] ABSTRACT

A toy stove with an enclosure having a rotatable vertical threaded shaft therein, with a bell carrier threadedly received thereon, the carrier having a bell attached thereto. A hinged door mechanism is provided with an actuating lever, which upon opening of the door, elevates the bell carrier by first lifting the shaft to allow it to rotate during lifting of the bell insert member. After closing of the door, the shaft drops and oscillates with the bell descending thereon until contact by the bell with a striker member for emitting a sound simulating completion of the timing cycle.

22 Claims, 5 Drawing Figures

Fig. 1
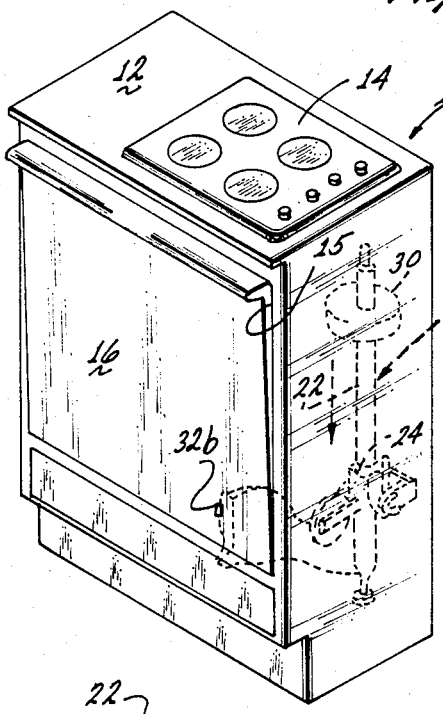
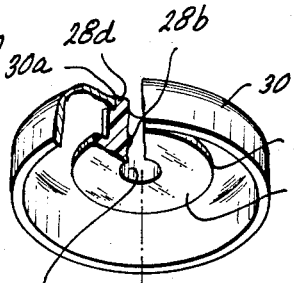
Fig. 2
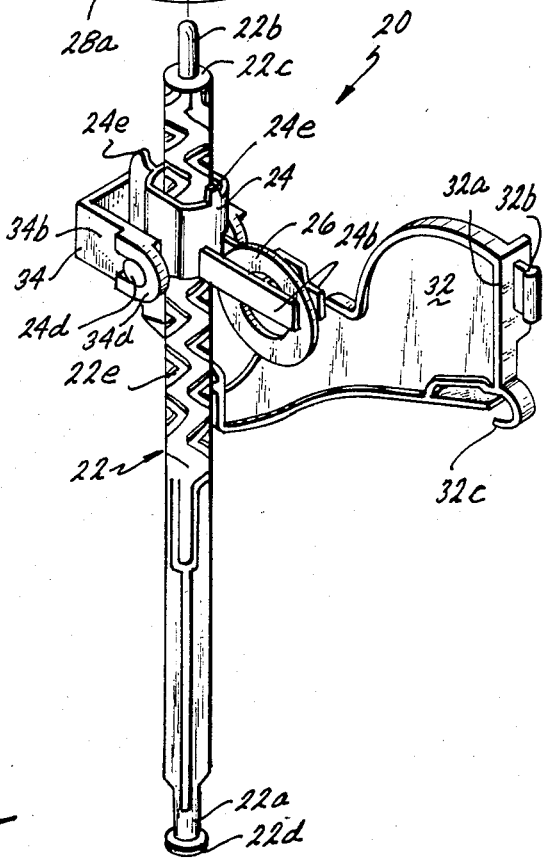
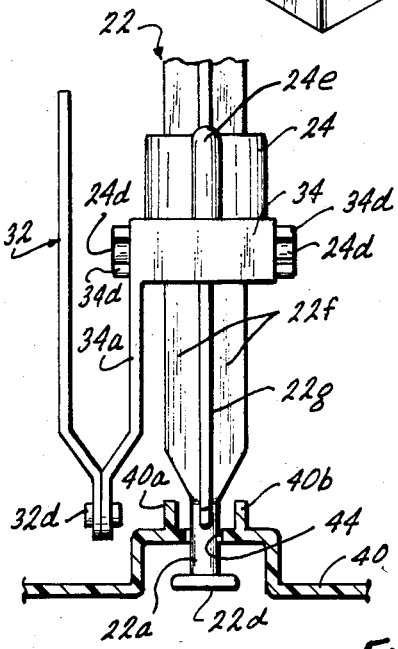
Fig. 5

TOY STOVE WITH SIMULATED TIMER

BACKGROUND OF THE INVENTION

The background of the invention will be discussed in two parts:

1. Field of the Invention

This invention relates to toy stoves, and more particularly to a toy stove which has a simulated timer device, with an audible indicator.

2. Description of the Prior Art

In a doll play setting various articles may be provided to enhance the amusement to the child. Such articles may include well recognized articles of furniture and the like. The amusement value of such articles is enhanced when such articles are provided with some form of mechanism which duplicates some element of the actual article.

One such article in the form of a "Toy Toaster" is shown and described in U.S. Pat. No. 3,765,120 issued Oct. 16, 1973 to Waak , the toaster including simulated bread, which is popped up in response to a spring-actuated timing mechanism which is actuated when a lever is depressed to lower the simulated bread into the toaster.

An electrically actuated timing mechanism is shown and described in U.S. Pat. No. 1,522,988, entitled "Time Switch", issued Jan. 13, 1925 to Warren, the switch being intended for use in kitchen electrical ranges.

U.S. Pat. No. 2,227,182, issued Dec. 31, 1940 to Finch et al is for a "Parking Meter" in which a visible indicator is carried on a carriage cooperating with a motor-driven threaded shaft, the carriage including a selectively actuated pawl member which engages the thread of the shaft. The pawl is retracted upon depositing of a coin and the carriage drops under the force of gravity, whereupon the pawl is engaged and the carriage is motor driven to the top.

It is an object of the present invention to provide a new and improved toy stove.

It is another object of the present invention to provide a new and improved toy stove with a simulated timing mechanism.

It is a further object of the present invention to provide a new and improved toy stove with a simulated timing mechanism with an audible signal.

SUMMARY OF THE INVENTION

The foregoing and other objects are accomplished by providing a toy stove with an enclosure having a rotatable helically threaded shaft therein, with a bell carrier member threadedly received thereon, the member having a bell attached thereto. A hinged door provides access to a part of the enclosure, with an actuating lever attached thereto, and upon opening of the door, the lever through another carrier on the shaft elevates the bell carrier member by first lifting the shaft to allow it to rotate during lifting of the bell carrier member. Upon closing the door, the shaft drops into a position permitting oscillatory motion during downward descent of the bell carrier member thereon until the bell contacts a striker member for emitting a sound simulating completion of the timing cycle.

Other objects, features and advantages of the invention will become apparent from a reading of the specification, when taken in conjunction with the drawings, in which like reference numerals refer to like elements in the several views.

BRIEF DESCRIPTION OF THE DRAWINGS

FIG. 1 is a perspective view of the toy stove with simulated timing mechanism according to the present invention;

FIG. 2 is an exploded perspective view of the timing mechanism and actuating components, partly broken away, as used in the toy stove of FIG. 1;

FIG. 5 is a rear view, partially in cross-section and partially broken away of the timing mechanism and actuating components of FIG. 4 as viewed generally along line 5—5 thereof.

DESCRIPTION OF THE PREFERRED EMBODIMENT

Figure 3:
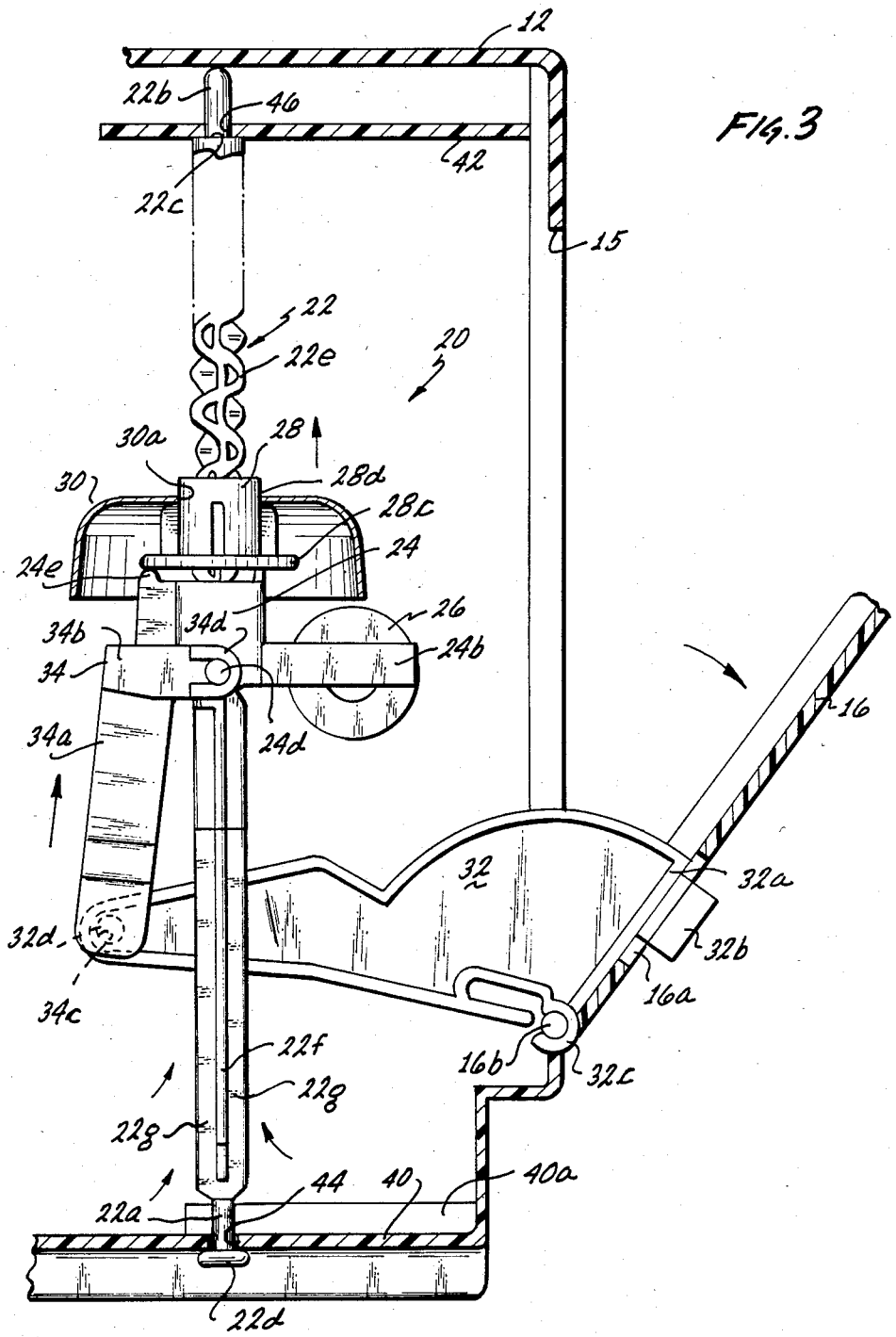
FIG. 3 is a side elevational view of the toy stove of FIG. 1, partially in cross-section, depicting the components of the timing and actuating mechanism in partly actuated position.

Referring now to the drawings, and particularly to FIG. 1, there is shown an enclosure configured as a toy stove, generally designated 10, having a planar upper surface 12 with a cooktop range portion 14, and a lower oven portion accessible through an opening 15 (See FIG. 3) with an openable oven door 16. Within the enclosure of the toy stove 10, there is an enclosed compartment not accessible to the user, which houses, as shown in dotted lines, an actuating and timing mechanism, generally designated 20, which, as will be hereafter described, simulates the timing of a conventional oven timer with an audible signal at the end of the timing cycle.

FIG. 2 illustrates the components of the bell, actuating and timing mechanism 20, which consist of a threaded timer shaft 22, a striker carrier 24 loosely surrounding the shaft 22 for movement thereon, a washer-shaped striker 26 supported by the carrier 24, a bell carrier member 28 threadably engaging the shaft 22, a bell 30 attached to the bell carrier member 28 for impact with the striker member 26, an actuating lever 32 configured for attachment to the oven door 16, and a push rod member 34 pivotally attached to the striker carrier member 24 and actuated by interconnection with the actuator lever 32.

By referring now to FIGS. 3 through 5, as well as to FIG. 2, the mechanism 20, its interconnections and its operation will be described. The interior of the enclosure forming the stove 10 is provided with first and second generally parallel generally horizontal wall portions 40 and 42 spaced a distance sufficient for loosely and rotatably supporting the timer shaft 22 in a generally vertical direction.

The lower wall 40 is provided with a bearing aperture 44 with the upper wall portion 42 having a vertically aligned bearing aperture 46 formed therein. As shown, the lower end of shaft 22 is configured to provide a reduced diameter journal bearing **22*a* which is of a diameter slightly smaller than the diameter of the aperture 44. Similarly, the upper end of shaft 22 is provided with a second reduced diameter journal bearing 22*b* for passage through and rotation within bearing aperture 46**, this reduction in diameter forming a shoulder 22*c* in proximate relation to the bearing 22*b*. A cap portion 22*d* of a diameter larger than the aperture 44 is placed on the lower end of shaft 22 to preclude dislodgement of the shaft 22 from its bearings.

The overall length of the shaft 22 from the cap to the shoulder 22*c* of the reduced diameter end 22*b* is slightly less than the distance between the opposing wall portions 42 and 44 to provide for vertical play in the shaft 22. The intermediate portion 22*e* of the shaft 22 is threaded, preferably with an alternating right hand/left hand helical or zig-zag thread. In practice, the shaft 22 is a molded plastic part with the helical thread portion 22*e* formed therein. The purpose of the vertical play of the shaft 22 will be discussed hereafter with relation to the operation of the mechanism 20.

The striker carrier member 24 is formed with an opening 24*a* (see FIG. 4) which is slightly larger than the diameter of the shaft member 22 for passage of the shaft member 22 therethrough. The carrier member 24 also includes a generally H-shaped portion generally perpendicular to the axis of the opening 42*a*, this H-shaped portion being formed with a pair of forwardly extending resiliently separable spaced arms 24*b*, with one arm 24*b* having an integrally formed perpendicularly extending leg 24*c*. The arms may be separated for loosely placing thereon the metallic washer-shaped striker member 26.

Extending from opposite sides of the carrier member 24 are a pair of aligned projections 24*d* which form an axis for pivotal coupling to the pusher member 34. As illustrated in FIGS. 3 through 5, the pusher member 34 is generally L-shaped in side view with a leg 34*a* and a pair of aligned arms 34*b* generally perpendicular thereto. The lower end of leg 34*a* is formed with an aperture 34*c* for pivotal coupling to one end of the actuating lever 32. The outer ends of arms 34*b* are formed with generally U-shaped bearing portions 34*d* for pivotally receiving the projections 24*d* of the striker carrier member 24. As shown in FIG. 5, the leg 34*a* is provided with offset portions for pivotal connection to the horizontally displaced lower end of the actuating lever 32.

Figure 4:
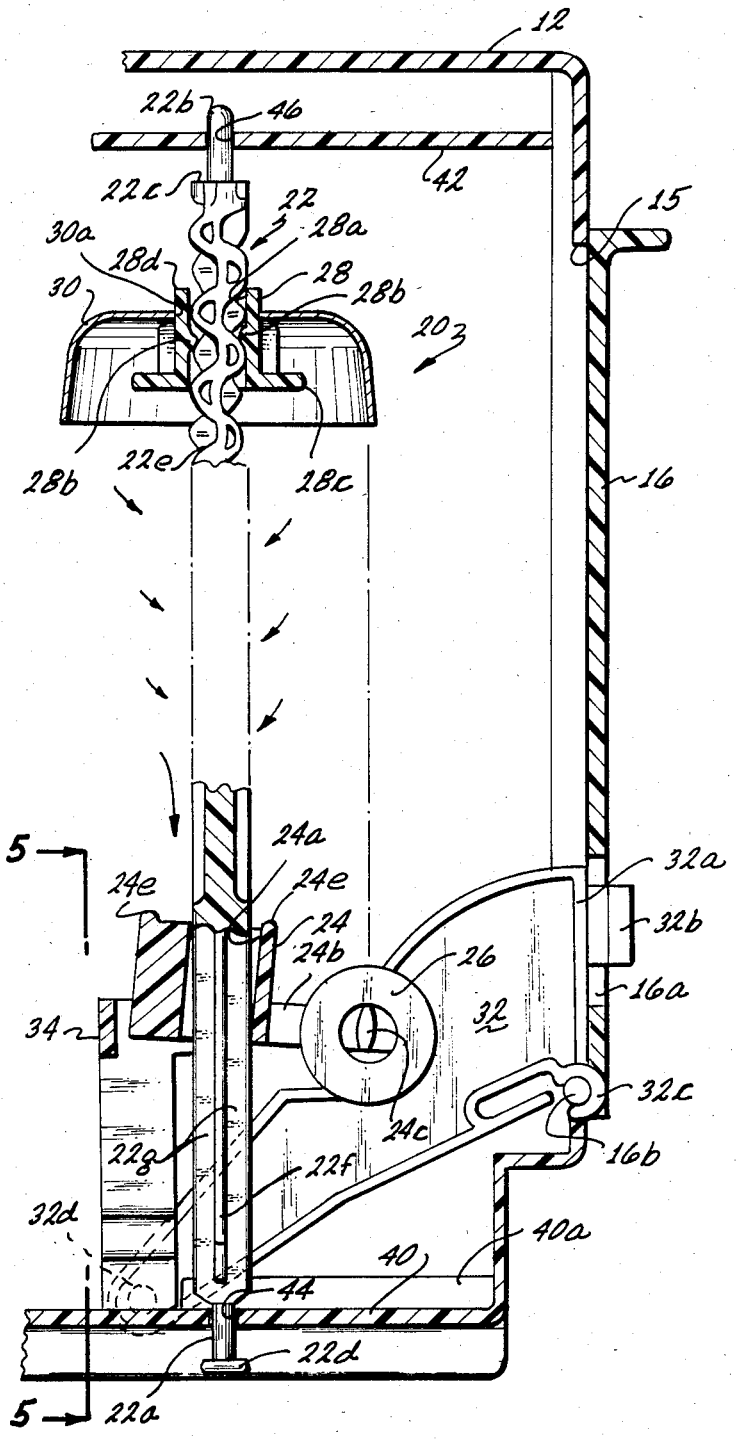
FIG. 4 is a side elevational view of the toy stove of FIG. 1, partially in cross-section, similar to FIG. 3, depicting the components of the timing and actuating mechanism in fully actuated position.

The actuating lever 32, as shown in FIGS. 3 and 4, is generally L-shaped at an obtuse angle with a first edge 32*a* having a clamp projection 32*b* for detenting engagement within a slot 16*a* of the oven door 16. The elbow portion of actuating lever is provided with a hinge opening 32*c* for engagement about the hinge projection 16*b* of the oven door 16. The long arm of the actuating lever 32, at its outermost tip is provided with an aperture for pivotal engagement with the aperture 34*c* in the push rod member 34, by interconnection with a suitable rivet member 32*d*.

Assembled on the shaft 22 is the bell carrier 28, which has an aperture 28*a* extending therethrough (see FIG. 4), with an inwardly extending integrally formed pair of dimples 28*b* on the inner surface thereof. The diameter of the aperture 28*a* is slightly greater than the diameter of the shaft 22 with the inner spacing between dimples 28*b* being sufficient for engagement with the alternating zig-zag threads of the helically threaded portion 22*e* of the timer shaft 22. The lower surface of the carrier 28 is provided with an enlarged flange portion 28*c* and the upper part has a necked down portion 28*d*. The bell 30 which is generally of an inverted cup-shaped configuration has an enlarged opening 30*a* which is frictionally secured to the necked down portion 28*d* of the bell carrier member 28 with the outer edge of the bell 30 in generally vertical alignment with the striker member 26 for impact therewith. The lower flange 28*c* of the bell carrier member 28 is configured for engagement by upwardly extending diametrically opposed tabs 24*e* formed in the upper edge of striker carrier 24.

The operation of the actuating and timing mechanism will be described with reference to FIGS. 3 through 5. Initially, the shaft 22 is provided with a first pair 22*f* of vertically extending ribs, and a second pair of vertically extending ribs 22*g*, which provide a cruciform cross-section to the shaft 22. As more fully shown in FIG. 5, the ribs 22*g* extend downwardly on shaft 22 a greater distance than the ribs 22*f*. These ribs 22*f* and 22*g* coact with means formed integrally with lower wall 40, these means being in the form of a pair of vertically extending spaced ribs 40*a* and 40*b* (See FIG. 5) positioned on both sides of the aperture 44 which receives the journal bearing 22*a* of the shaft 22.

In the normal position of the components, by reference to FIGS. 4 and 5, the shaft 22 is in its lowermost position as shown therein, at which point the ribs 22*g* extend into the space between the ribs 40*a l and 40b*, thus permitting oscillation but not rotation of shaft 22. In this normal position, with the door 16 closed as shown in FIG. 4, the striker carrier member 24 is tilted clockwise, as viewed therein, due to the weight of the washer-shaped striker member 26.

In operation of the mechanism 20, upon opening of the door 16, the actuating lever 32 is pivoted in a clockwise direction as viewed in FIG. 3, thus directing the push rod member 34 upwardly, along with the striker carrier member 24. The tabs 24*e* of the striker carrier member 24 are urged against the lower enlarged flange 28*c* of the bell carrier 22*b*, which is being urged upwardly, as viewed in FIG. 3, which depicts the components of the timing mechanism 20 in the partially operated condition. At this point, the engagement of the tabs 24*e* with the flange 28*c* urges the striker carrier member 24 slightly counterclockwise to a more level position.

During this initial movement, the timer shaft 22 is raised until the shaft ribs 22*g* are above the upper edges of the side ribs 40*a* and 40*b* (See FIG. 3) with the uppermost tip of the reduced diameter journal bearing 22*b* urging against the interior of the stove top surface 12, with the shoulder 22*c* of the reduced diameter end 22*b* in abutting relation with, or in proximate relation to the upper wall portion 42. At this point, the shaft 22 is free to rotate or oscillate in a zig-zag manner, with the inner surface 12 acting as a thrust bearing for this rotation.

Due to the engagement of the dimples 28*b* of the bell carrier 28 with the helical thread 22*e* of the shaft 22, either the shaft 22 or the bell carrier 28 must rotate. However, inasmuch as the bell 30 is metallic, the combined mass of the bell 30 and bell carrier 28 exceeds the mass of the shaft 22. Therefore, as the timer shaft 22 is lifted, the bell carrier 28 remains stationary as indicated by the arrow thereabove in FIG. 3, and the shaft 22 rotates or oscillates in alternate directions (as indicated by the arrows at the lower end thereof) within the bearing apertures 44 and 46 with incremental axial movement, about the uppermost tip of shaft 22.

As the door 16 reaches its full open position, the bell carrier 28, along with the bell 30 are at maximum elevation. The door 16 is then closed with the position of the components at the onset of the timing cylce being as shown in FIG. 4. In this position, the striker carrier member 24 has again returned to its pivoted or tilted position.

Under the force of gravity, the weight of the bell 30 and bell carrier 28 urge the timer shaft downwardly until shaft ribs 22*g* are again resting loosely between the wall ribs 40*a* and 40*b* as depicted in FIG. 5, thus permitting oscillation while precluding rotation of shaft 22. Under the force of gravity, the bell carrier 28 and the bell 30, as a unit, cause oscillation of the shaft 22, as indicated by the arrows in FIG. 4, alternately back and forth in its incremental downward descent along the helically threaded portion 22*e* of the timer shaft 22. As the bell 30 and bell carrier member 28 reach the lowermost limit of travel on shaft 22, the assembly has accelerated, at which point the impact of the flange 28*c* with the tabs 24*e* of the carrier member 24 suddenly pivots the carrier 24 causing upward movement of the loosely assembled washer-shaped striker 26, immediately after which, the striker member 26 returns to a position spaced from the bell member 30. This upward movement of the striker 26 occurs simultaneously with the downwardly descending bell 30 reaching its lowest position at which point, the outer edge of the bell 30 impacts with the loosely mounted washer-shaped striker member 26 emitting a bell like tone duplicating the tone of the bell on a conventional kitchen stove after the elapsed time has expired. The length of the threaded portion 22*e* of the timer shaft 22 is such that approximately five seconds elapse from the closing of the oven door 16 until the impact of the bell 30 with the striker member 26.

While a continuous thread may be utilized on shaft 22, the time duration for travel the distance of the threaded portion 22*e* would be reduced. By utilization of the alternating or zig-zag thread configuration, the net effect is to act as somewhat of an escapement mechanism, in that during the downward descent, the timer shaft 22, relative to the bell carrier 28, rotates first clockwise for the length or pitch of a first thread, then counter-clockwise for the axial length or pitch of the next thread, and so on, and at each change of direction, the bell carrier 28 comes to a halt during this downward incremental movement, thus decelerating the bell 30 and bell carrier 28 assembly to increase the elapsed time of the mechanism. With this thread configuration, the time duration of travel of the bell carrier 28 down the length of shaft 22 is significantly increased, thus enabling a shorter shaft 22 to be used for a given time duration of travel.

In the embodiment illustrated, the shaft 22, the actuating lever 32, the shaft member 22, the carrier striker carrier 24 and the bell carrier 28 are preferably formed by molding of a plastic material with the bell member 30 and the striker member 26 being formed of metal. As such, the bell, timing and actuating mechanism 20 is low cost and uncomplicated in manufacture and very reliable to perform the function of simulating an actual timer of a conventional oven.

While there has been shown and described a preferred embodiment, it is to be understood that various other adaptations and modifications may be made within the spirit and scope of the invention.

I claim:

1. In a toy stove, the combination comprising:

an enclosure having an opening simulating an oven opening;

a door hingedly coupled to said enclosure for closing and providing access through said opening;

bell means mounted within said enclosure;

timer means mounted within said enclosure; and actuating means within said enclosure interoperatively interconnecting said door, said timer means and said bell means for enabling actuation of said bell means a predetermined time after closing of said door.

2. The combination according to claim 1 wherein said actuating means includes an actuating lever coupled to said door.

3. The combination according to claim 2 wherein said timer means includes a shaft with said bell means movably mounted thereon.

4. The combination according to claim 1 wherein said combination further includes striker means mounted in said enclosure for physically contacting said bell means.

5. The combination according to claim 4 wherein said timer means includes a shaft member within said enclosure, with said bell means on said shaft member for being elevated in response to actuation of said actuating means and for being released under the force of gravity for impacting with said striker means.

6. The combination according to claim 5 wherein said shaft member includes thread means and said bell means threadably cooperates therewith.

7. The combination according to claim 6 wherein said actuating means includes an actuating lever coupled to said door and carrier means on said shaft member coupled to said actuating lever for elevating said bell means upon opening of the door, and for enabling the descent of said bell means under the force of gravity for impact with said striker means.

8. The combination according to claim 7 wherein said thread means is an alternating left hand/right hand helical thread and said bell means oscillates said shaft member during its descent.

9. The combination according to claim 8 wherein said shaft member is dimensioned for being slightly lifted during elevation of said bell means by said actuating lever for enabling to and fro rotation thereof.

10. The combination according to claim 4 wherein said timer means includes a shaft member with said bell means movably mounted thereon, and said striker means includes a striker carrier member loosely mounted for movement on said shaft member in response to said actuating means.

11. The combination according to claim 10 wherein said striker means also includes a metallic washer means loosely coupled to said striker carrier member with impact of said striker carrier member by said bell means on its downward descent pivoting said striker carrier member to urge said washer means upwardly into physical contact with said bell means.

12. In a toy stove having an enclosure with an opening simulating an oven opening and a hinged door mounted thereon for closing and providing access through said opening, the combination comprising:

bell means mounted within said enclosure;

timer means mounted within said enclosure; and actuating means within said enclosure interoperatively interconnecting said door, said timer means and said bell means for enabling actuation of said bell means a predetermined time after closing of said door.

13. The combination according to claim 12 wherein said combination further includes striker means mounted in said enclosure for impact with said bell means and said timer means includes a shaft member within said enclosure, with said bell means movably mounted on said shaft member for being elevated in response to actuation of said actuating means upon opening of said door and for being released upon closure of said door under the force of gravity for impacting with said striker means.

14. The combination according to claim 13 wherein said shaft member includes thread means and said bell means threadably cooperates therewith.

15. The combination according to claim 14 wherein said actuating means includes an actuating lever coupled to said door and carrier means on said shaft coupled to said actuating lever for elevating said bell means upon opening of the door, and for enabling the descent of said bell means under the force of gravity for impact with said striker means.

16. The combination according to claim 15 wherein said thread means is an alternating right hand/left hand thread and said bell means oscillates said shaft member during its descent.

17. The combination according to claim 16 wherein said shaft member is dimensioned for being slightly lifted during elevation of said bell means by said actuating lever for enabling to and fro rotation thereof.

18. In a timing mechanism for placing in an enclosure of a toy or the like, the combination comprising:

a shaft member at least partially rotatably mounted in a vertical position within said enclosure;

thread means on at least a portion of said shaft member;

carrier means on said shaft member for coaction with said thread means;

actuating means mounted in interoperative structural relation with said shaft member and said carrier means for engaging said carrier means and lifting said shaft member to permit rotation thereof simultaneously with elevation of said carrier means, and for lowering said shaft member into a lower position for limited rotational movement during descent of said carrier means thereon under the force of gravity; and other means mounted within said enclosure for coaction with said carrier means after a predetermined distance of downward travel thereof to effect a timer signal.

19. The combination according to claim 18 wherein said carrier means includes bell means and said other means includes means for impacting said bell means for providing an audible signal.

20. The combination according to claim 19 wherein said actuating means includes an actuating lever.

21. The combination according to claim 20 wherein said enclosure includes a door and said actuating lever is coupled thereto for actuation in response to opening and closing of said door.

22. The combination according to claim 19 wherein said thread means are configured for providing oscillatory movement of said shaft member during movement of said carrier means relative thereto.

* * * * *